US010755516B2

(12) United States Patent
Chang et al.

(10) Patent No.: US 10,755,516 B2
(45) Date of Patent: Aug. 25, 2020

(54) HANGING ROD CONTROL DEVICE FOR DISPLAY RACK

(71) Applicants: Ti Chin Chang, Tainan (TW); Tong Tsan Chien, Tainan (TW); Chia Ling Hsieh, Tainan (TW); Yao Ling Chang, Tainan (TW)

(72) Inventors: Ti Chin Chang, Tainan (TW); Tong Tsan Chien, Tainan (TW); Chia Ling Hsieh, Tainan (TW); Yao Ling Chang, Tainan (TW)

(73) Assignee: Brighton-Best International (Taiwan) Inc., Tainan (TW)

( * ) Notice: Subject to any disclaimer, the term of this patent is extended or adjusted under 35 U.S.C. 154(b) by 0 days.

(21) Appl. No.: 16/262,922

(22) Filed: Jan. 31, 2019

(65) Prior Publication Data

US 2019/0164378 A1 May 30, 2019

(30) Foreign Application Priority Data

Jul. 4, 2018 (TW) ..... 107123182 A

(51) Int. Cl.

| | |
|---|---|
| ***G07F 11/42*** | (2006.01) |
| ***G07F 11/26*** | (2006.01) |
| ***A47F 5/08*** | (2006.01) |
| ***G07F 11/64*** | (2006.01) |

(52) U.S. Cl.

CPC ..... *G07F 11/42* (2013.01); *A47F 5/0838* (2013.01); *G07F 11/26* (2013.01); *G07F 11/64* (2013.01)

(58) Field of Classification Search

CPC . A47F 5/0838; A47F 5/0861; B65D 73/0064; G07F 11/26; G07F 11/42; G07F 11/64

See application file for complete search history.

(56) References Cited

U.S. PATENT DOCUMENTS

| | | | | |
|---|---|---|---|---|
| 3,805,996 | A * | 4/1974 | Canning | A47F 5/0861 221/76 |
| 3,940,016 | A * | 2/1976 | Krakauer | G07F 11/42 221/129 |
| 6,131,748 | A * | 10/2000 | Kawasaki | A47F 1/128 211/54.1 |
| 10,016,070 | B1 * | 7/2018 | DeSena | A47F 5/0823 |
| 2008/0203253 | A1 * | 8/2008 | Vogler | A47F 1/128 248/220.31 |
| 2009/0057244 | A1 * | 3/2009 | Conti | A47F 5/0861 211/7 |

(Continued)

*Primary Examiner* — Gene O Crawford
*Assistant Examiner* — Kelvin L Randall, Jr.

(57) ABSTRACT

A hanging rod control device for a display rack includes a mounting member, a rod, a positioning assembly, a release assembly, a driven device, and a drive device. The mounting member is attached to the display rack. The rod has one end secured to the mounting member with items hung from the rod. The positioning assembly is secured to the mounting member and includes a front plate, a rear fastening member, a shaft interconnecting the front plate and the rear fastening member, and a sliding member having teeth. The release assembly is penetrated by both the shaft and the sliding member and includes arms and positioning plates arranged in alternating fashion. The driven device is disposed in the mounting member and includes a cam and a shaft member operatively connected to the cam.

4 Claims, 20 Drawing Sheets

(56) References Cited

U.S. PATENT DOCUMENTS

| | | | | |
|---|---|---|---|---|
| 2009/0095695 | A1* | 4/2009 | Moock | A47F 5/0861 211/57.1 |
| 2019/0374048 | A1* | 12/2019 | Valiulis | A47F 10/00 |

* cited by examiner

HANGING ROD CONTROL DEVICE FOR DISPLAY RACK

BACKGROUND OF THE INVENTION

1. Field of the Invention

The invention relates to control devices and more particularly to a hanging rod control device for a display rack so as to control the number of items being taken.

2. Description of Related Art

Conventionally, a wide variety of items (e.g., drinks, food, and consumer products) are sold by a vending machine. However, items such as wrenches, hammers, and pliers are not sold by a vending machine as far as the present inventors are aware of. This is because these hand tools are relatively heavy and thus it may strike an empty compartment of the vending machine when it is released. Unfortunately, the vending machine may be damaged after a short period of time of use.

It is typical that such hand tools are hung on a display rack of a hardware store. It is understood that the stores are only open in business hours. Thus, it is impossible of buying the hand tools in non-business hours. Some stores may open 24 hours a day. However, prices of the hand tools sold at the stores are much higher due to increased labor costs.

Thus, it is desirable of selling hand tools on a display rack with an operation mode similar to a vending machine so that it is possible of selling hand tools 24 hours a day with the labor costs decreased to a minimum.

SUMMARY OF THE INVENTION

It is therefore one object of the invention to provide a hanging rod control device for a display rack so that an operation mode of the vending machine is improved to an open mode.

It is another object of the invention to provide a hanging rod control device for a display rack so that the labor costs can be greatly decreased.

For achieving above and other objects, the invention provides a hanging rod control device for a display rack, comprising a mounting member, a rod, a positioning assembly, a release assembly, a driven device, and a drive device wherein the mounting member is configured to attach to the display rack; the rod has one end secured to the mounting member so that a plurality of items are configured to hang from the rod; the positioning assembly is secured to the mounting member and includes a front plate, a rear fastening member, a shaft interconnecting the front plate and the rear fastening member, and a sliding member wherein the shaft and the rod are parallel to each other; the shaft includes a grooved rail for allowing the sliding member to slide between two ends of the grooved rail; the sliding member includes a plurality of teeth; the more proximate the mounting member the greater of the length of the tooth is; and the front plate includes a light emitting member on an outer surface, and a label on the outer surface of the front plate; the release assembly is penetrated by both the shaft and the sliding member and disposed between the mounting member and the front plate; the release assembly includes a plurality of arms and a plurality of positioning plates arranged in alternating fashion; the arms and the positioning plates each include a through hole so that both the shaft and the sliding member are configured to pass through the through holes; each arm further comprises a plurality of positioning apertures, a recess on an edge of the through hole of the arm for allowing the arm to pivot a predetermined angle, and a cavity for allowing the rod to complementarily attach thereto; and each positioning plate further comprises a pin configured to insert into the positioning aperture for positioning the arm, and a plurality of hole members each for the receipt of the pin; the driven device is disposed in the mounting member and includes a cam having a plurality of connected facets and a shaft member operatively connected to the cam; and the drive device is disposed in the mounting member and operatively connected to the shaft member; and the drive device is configured to be a drive source.

For achieving above and other objects, the invention further provides a hanging rod control device for a display rack, comprising a mounting member, a rod, a positioning assembly, a release assembly, a driven device, and a drive device wherein the mounting member is configured to attach to the display rack; the rod has one end secured to the mounting member so that a plurality of items are configured to hang from the rod; the positioning assembly is secured to the mounting member and includes a front plate, a rear fastening member, a shaft interconnecting the front plate and the rear fastening member, and a sliding member wherein the shaft and the rod are parallel to each other; the shaft includes a grooved rail for allowing the sliding member to slide between two ends of the grooved rail; the sliding member includes a plurality of teeth; the more proximate the mounting member the greater of the length of the tooth is; and the front plate includes a light emitting member on an outer surface, and a label on the outer surface of the front plate; the release assembly is penetrated by both the shaft and the sliding member and disposed between the mounting member and the front plate; the release assembly includes a plurality of arms and a plurality of positioning plates arranged in alternating fashion; the arms and the positioning plates each include a through hole so that both the shaft and the sliding member are configured to pass through the through holes; each arm further comprises a plurality of positioning apertures, a recess on an edge of the through hole of the arm for allowing the arm to pivot a predetermined angle, and a cavity for allowing the rod to complementarily attach thereto; and each positioning plate further comprises a pin configured to insert into the positioning aperture for positioning the arm, and a plurality of hole members each for the receipt of the pin; the driven device is disposed in the mounting member and includes a connector connected to the sliding member, a lead screw connected to the connector for allowing the sliding member to move thereon, and a fastening element for securing the lead screw to the rear fastening member; and the drive device is disposed in the mounting member and operatively connected to the fastening element; and the drive device is configured to be a drive source for rotating the lead screw.

The invention has the following advantages and benefits in comparison with the conventional art: the driven device is used to control a moving distance of the sliding member. Whether a pivotal operation of the arm is made is based on the moving distance of the sliding member. A precise control of the items sold by the vending machine is made possible. An operation mode of the vending machine is improved to an open mode. A console may control each hanging rod control device, thereby greatly decreasing the labor costs.

The above and other objects, features and advantages of the invention will become apparent from the following detailed description taken with the accompanying drawings.

DETAILED DESCRIPTION OF THE INVENTION

Figure 1:
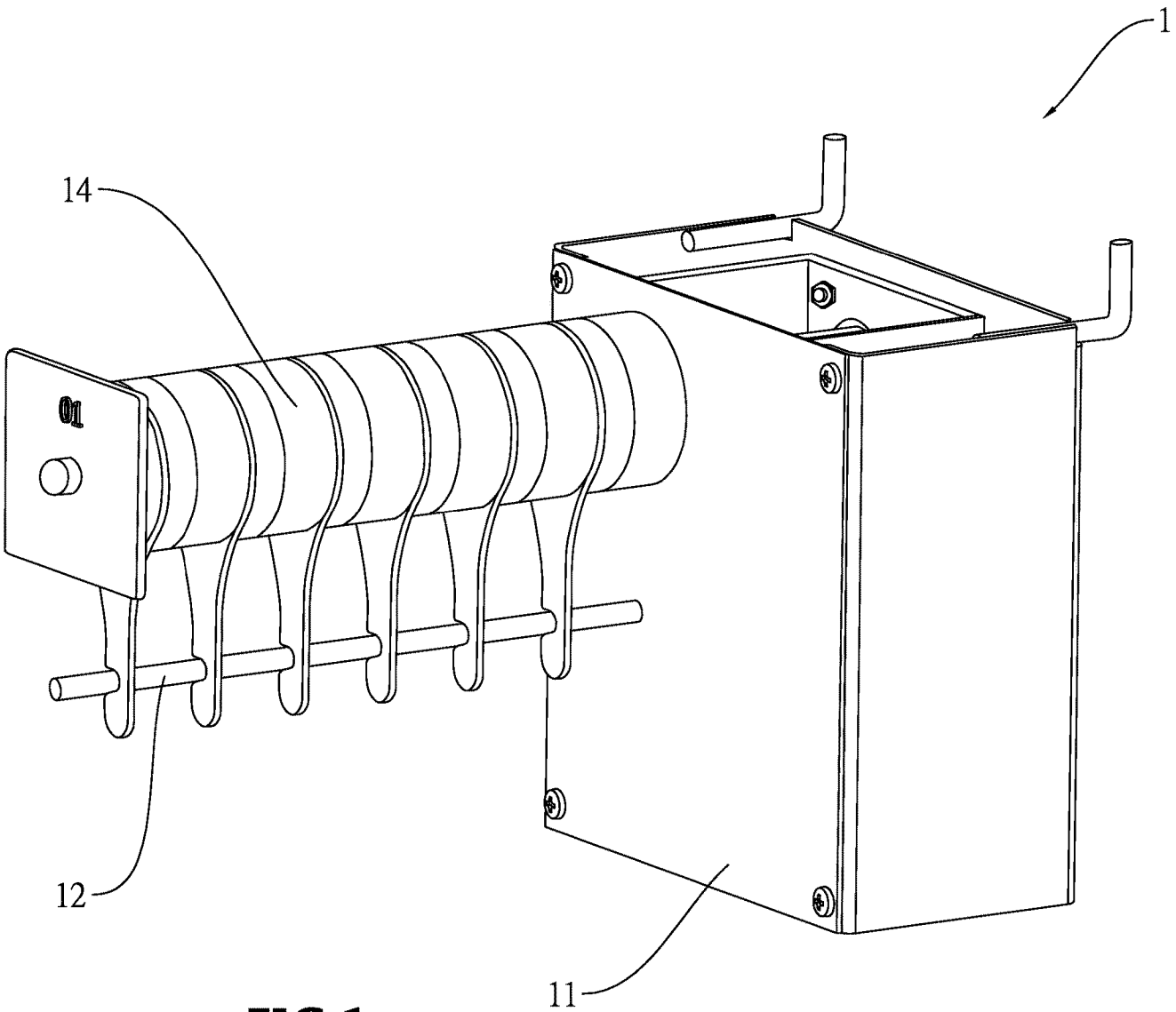
FIG. 1 is a perspective view of a hanging rod control device for a display rack according to a first preferred embodiment of the invention.
Figure 2:
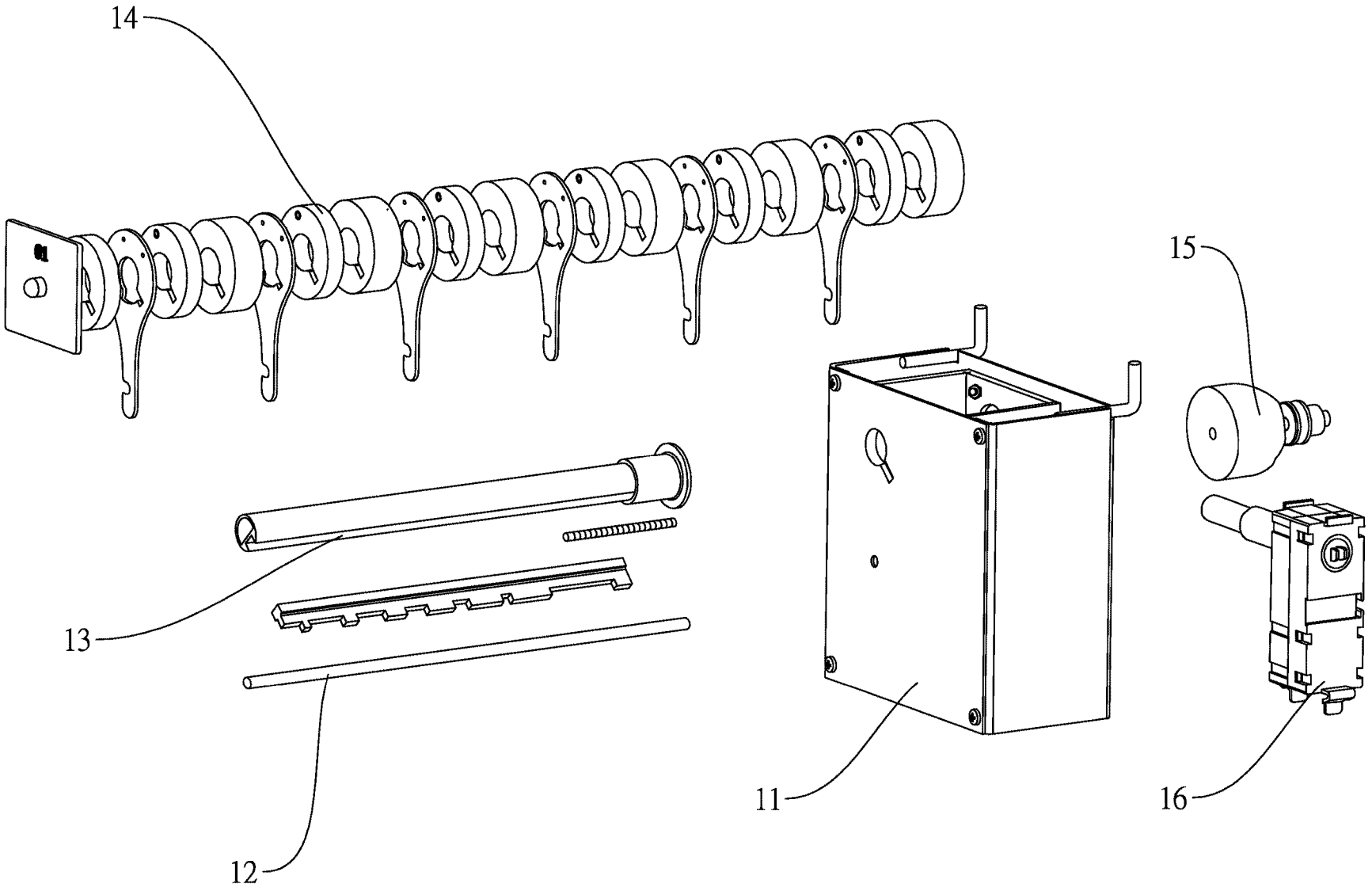
FIG. 2 is an exploded view of FIG. 1.
Figure 3:
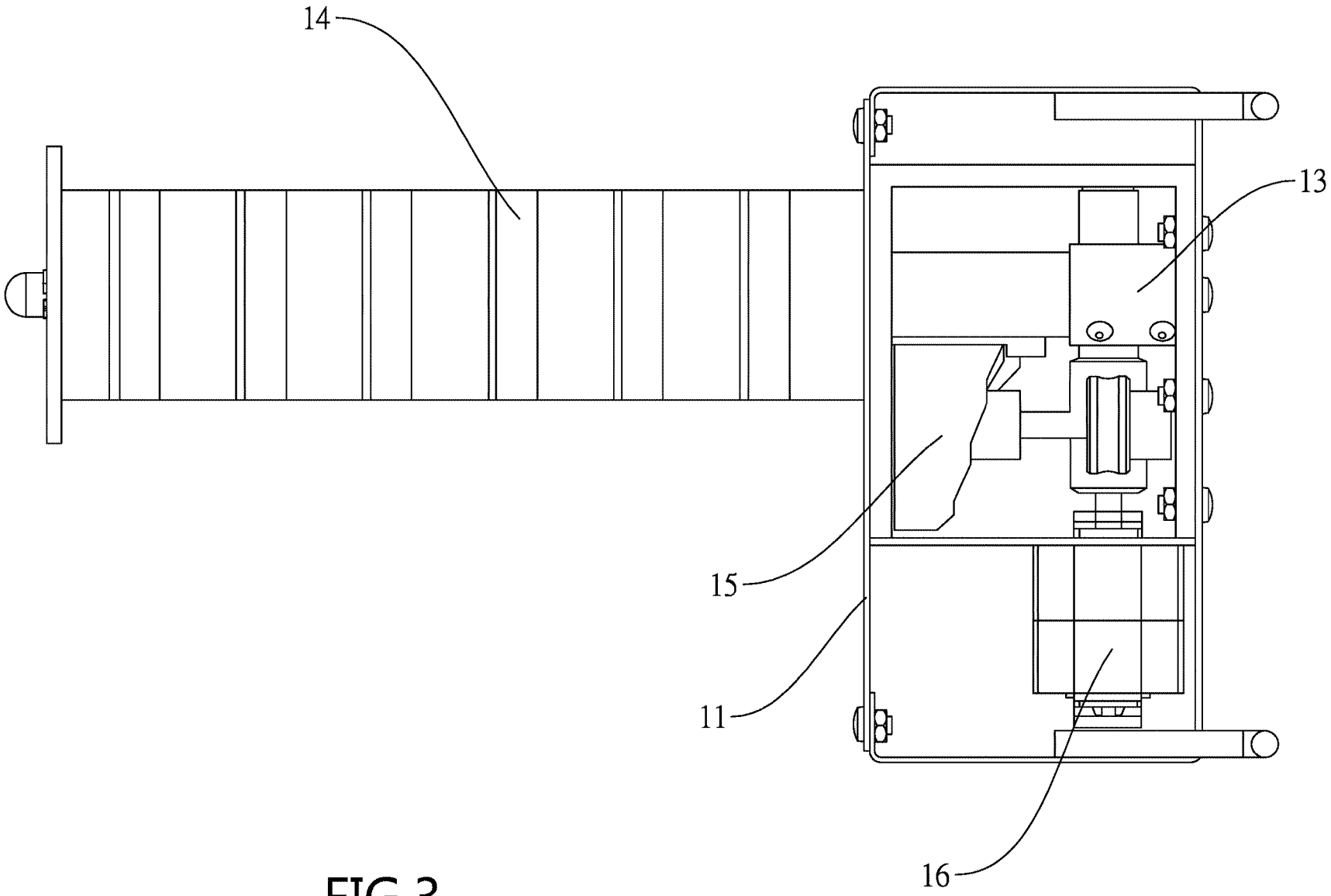
FIG. 3 is a top view of FIG. 1.
Figure 4:
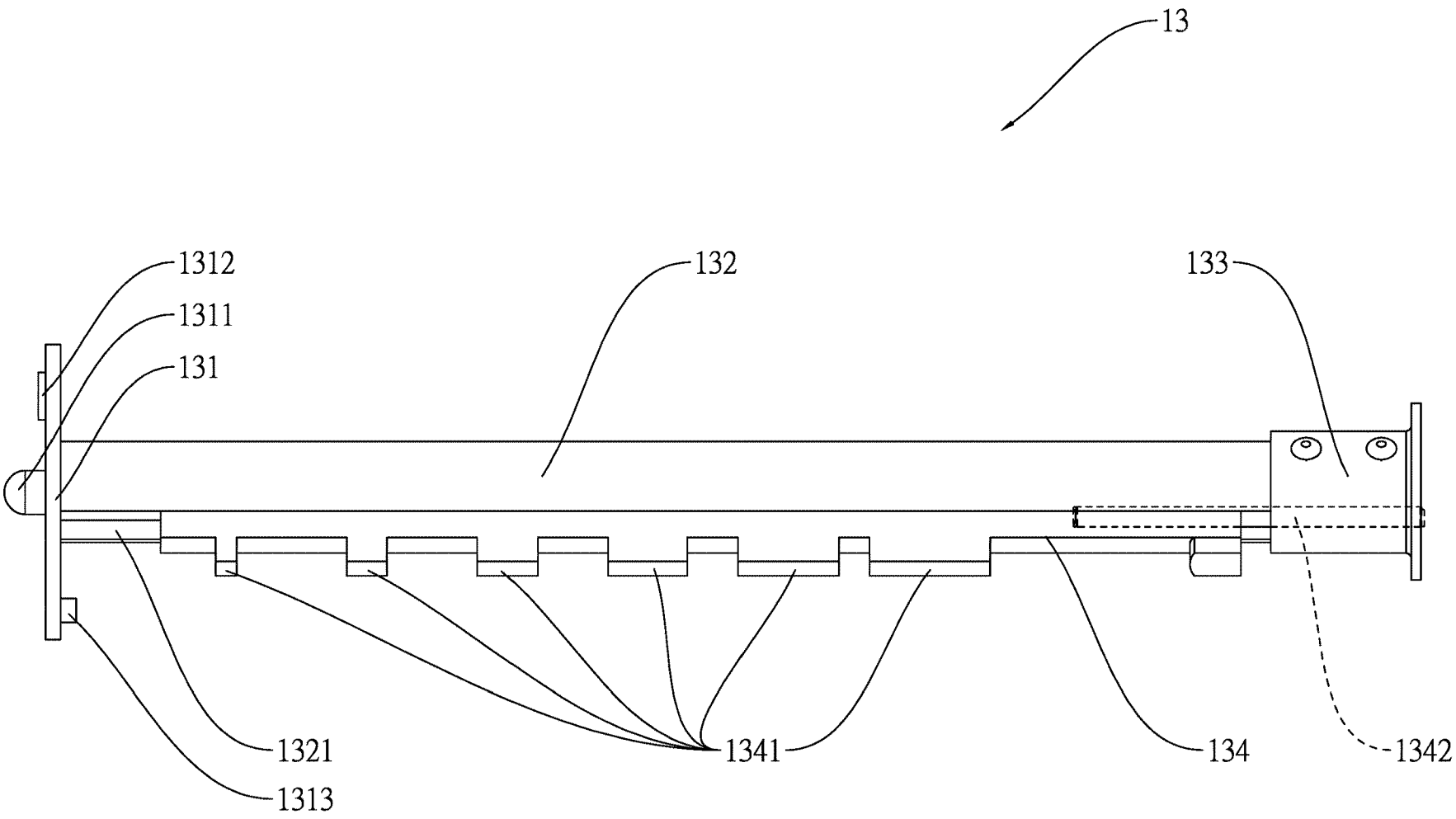
FIG. 4 is a side elevation of the positioning assembly.
Figure 5:
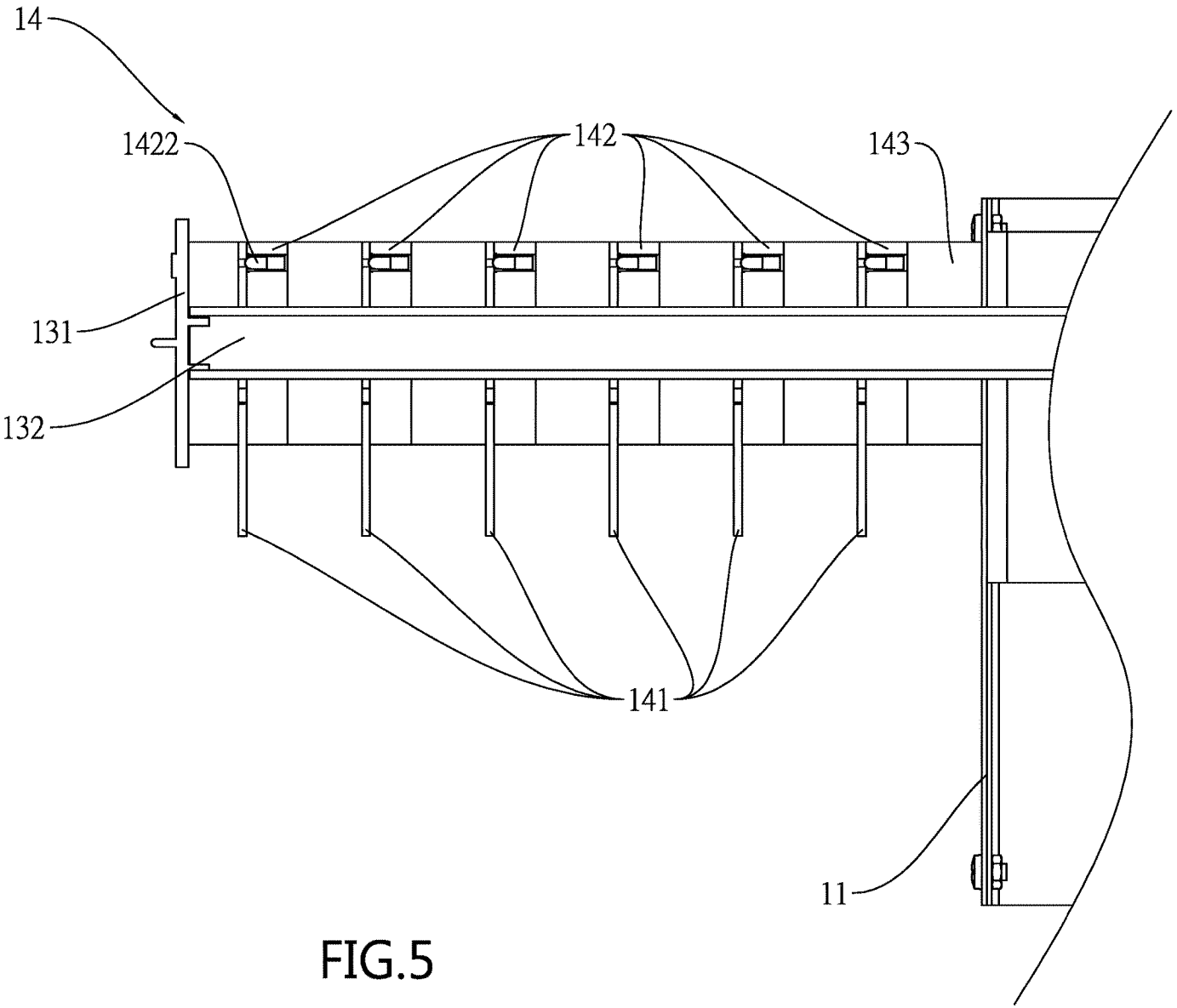
FIG. 5 is a longitudinal sectional view of the release assembly.
Figure 6:
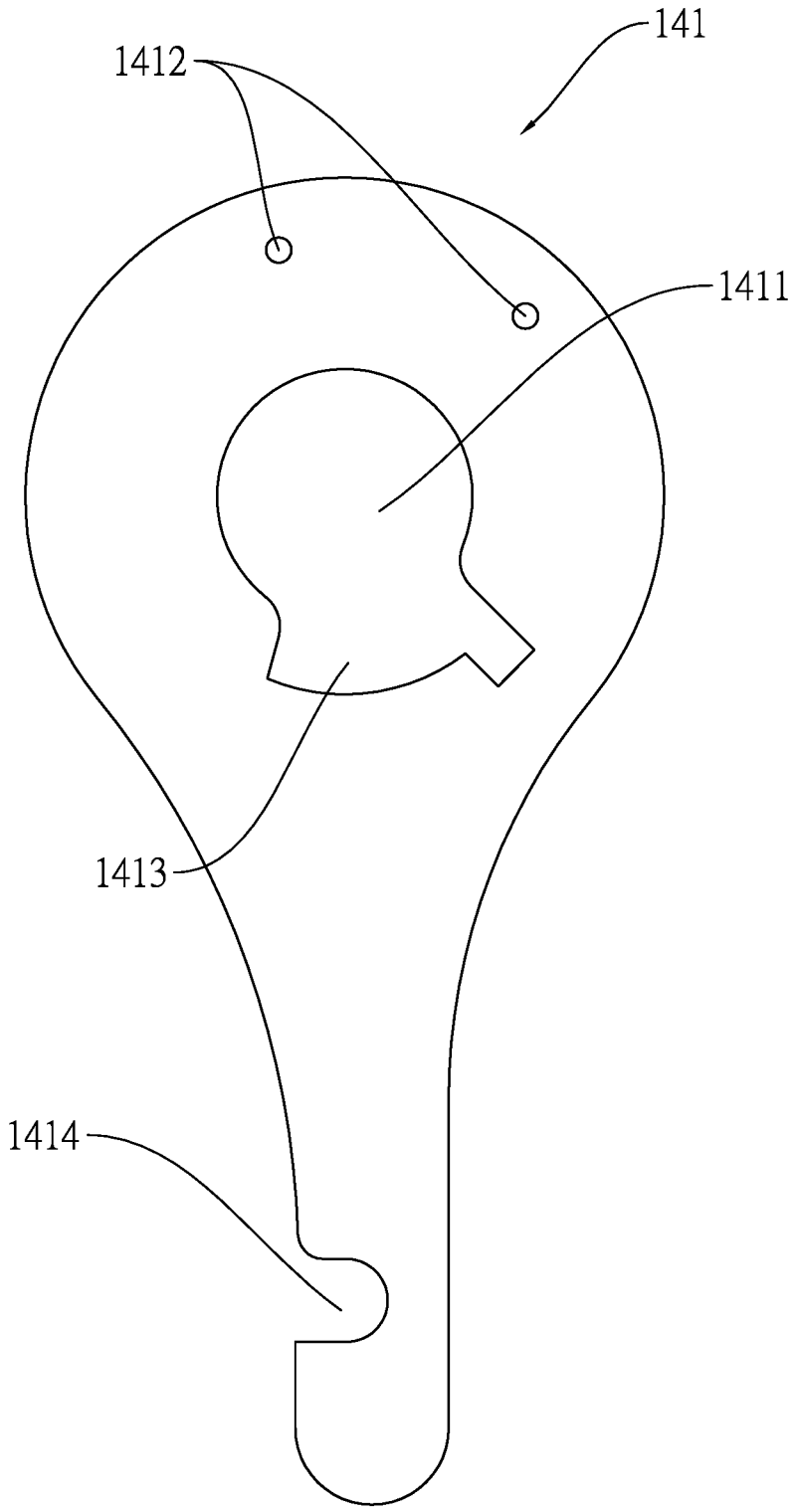
FIG. 6 is a front view of the arm.
Figure 7A:
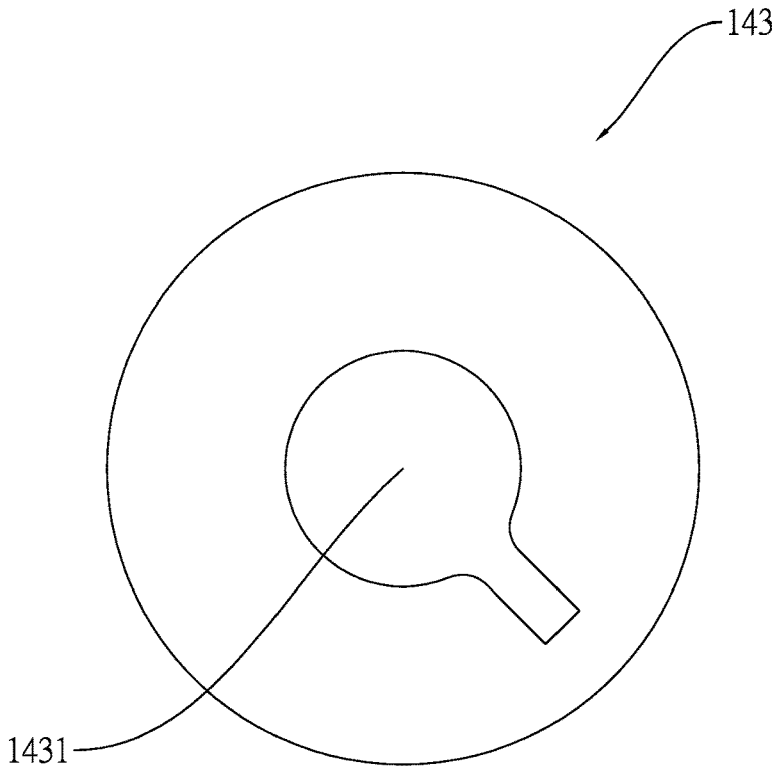
FIG. 7A is a front view of the rear spacer.
Figure 7B:
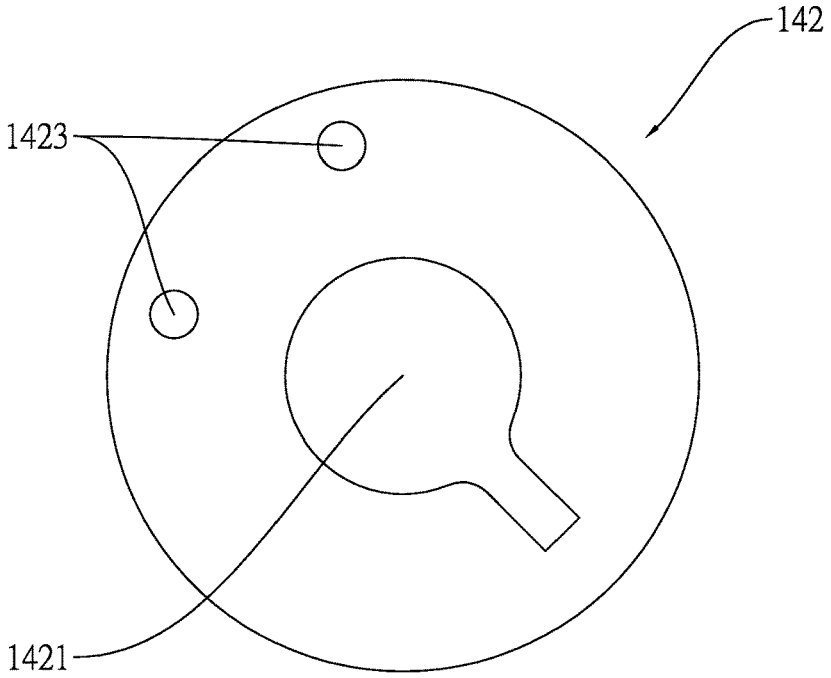
FIG. 7B is a front view of the positioning plate.
Figure 8:
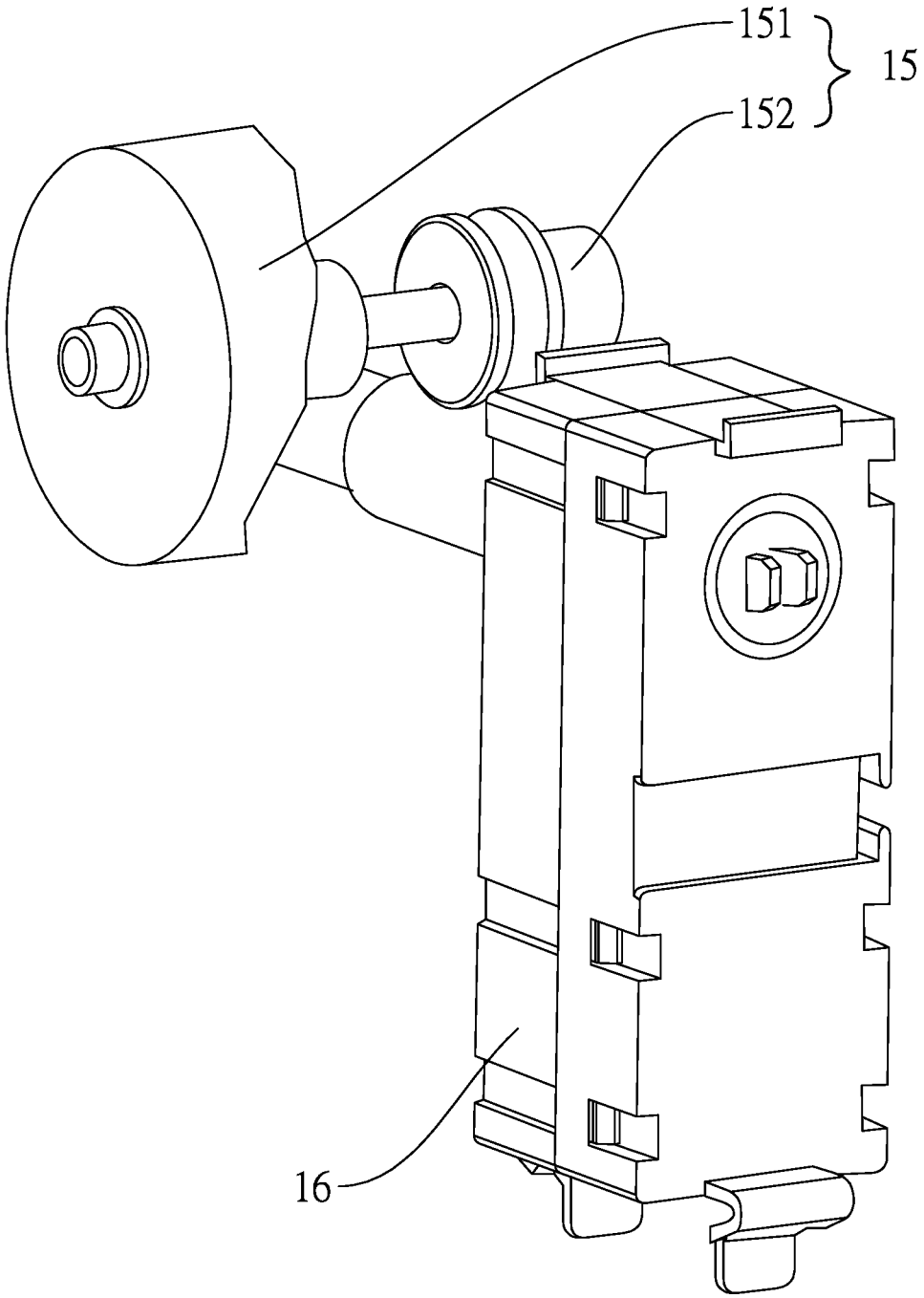
FIG. 8 is a perspective view of the driven device and the drive device.
Figure 9:
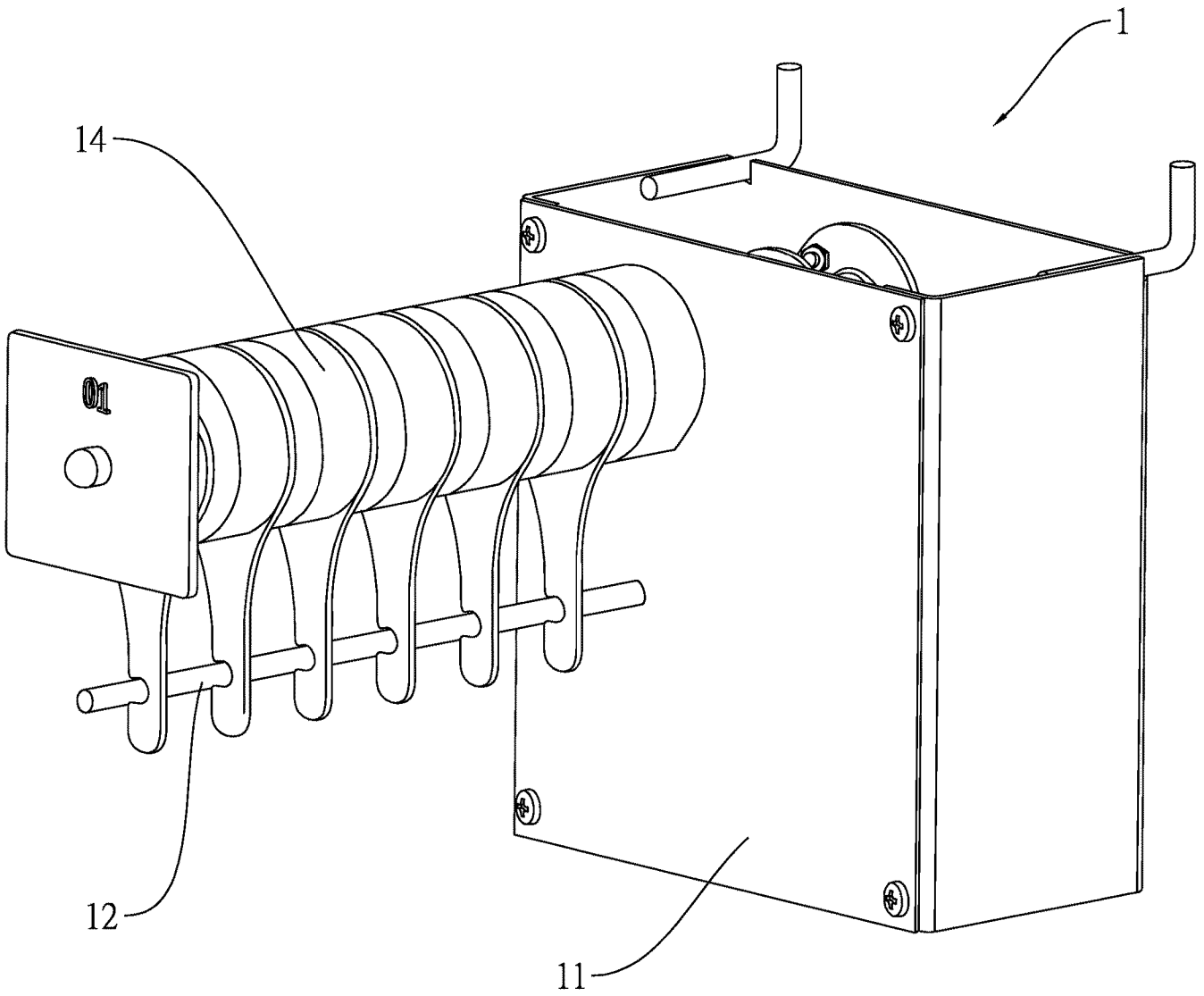
FIG. 9 is a perspective view of a hanging rod control device for a display rack according to a second preferred embodiment of the invention.
Figure 10:
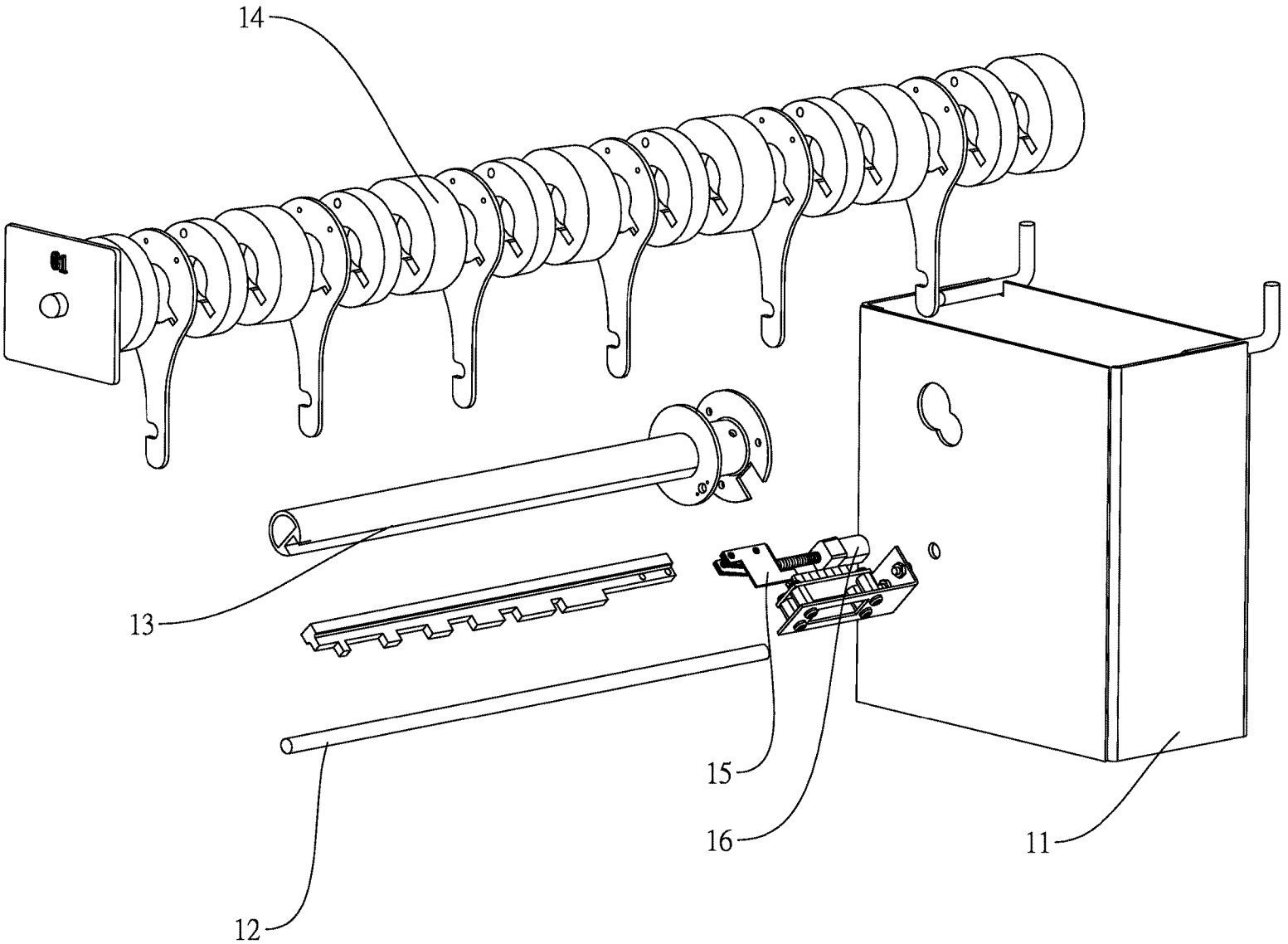
FIG. 10 is an exploded view of FIG. 9.
Figure 11:
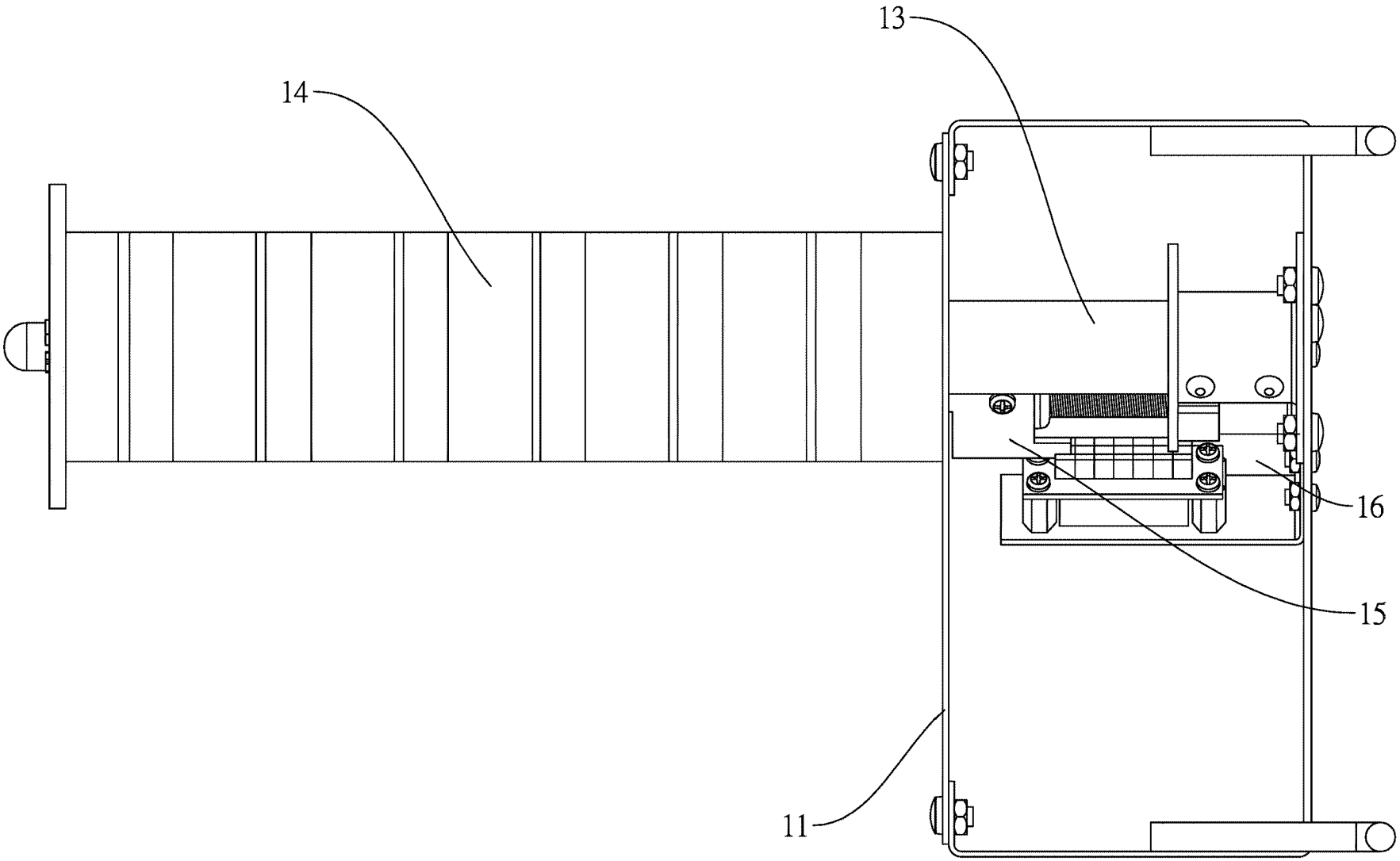
FIG. 11 is a top view of FIG. 9.
Figure 12:
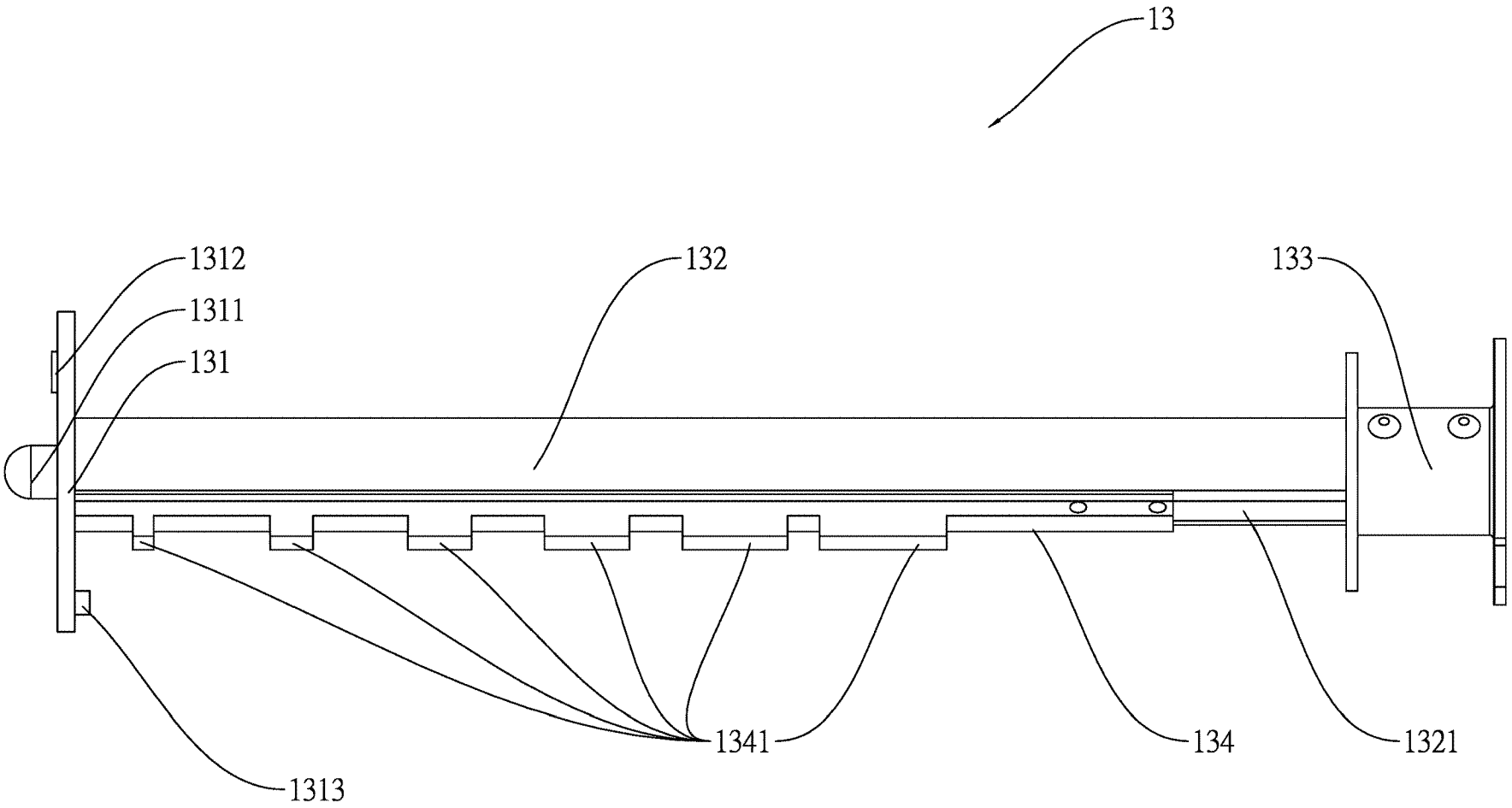
FIG. 12 is a side elevation of the positioning assembly.
Figure 13:
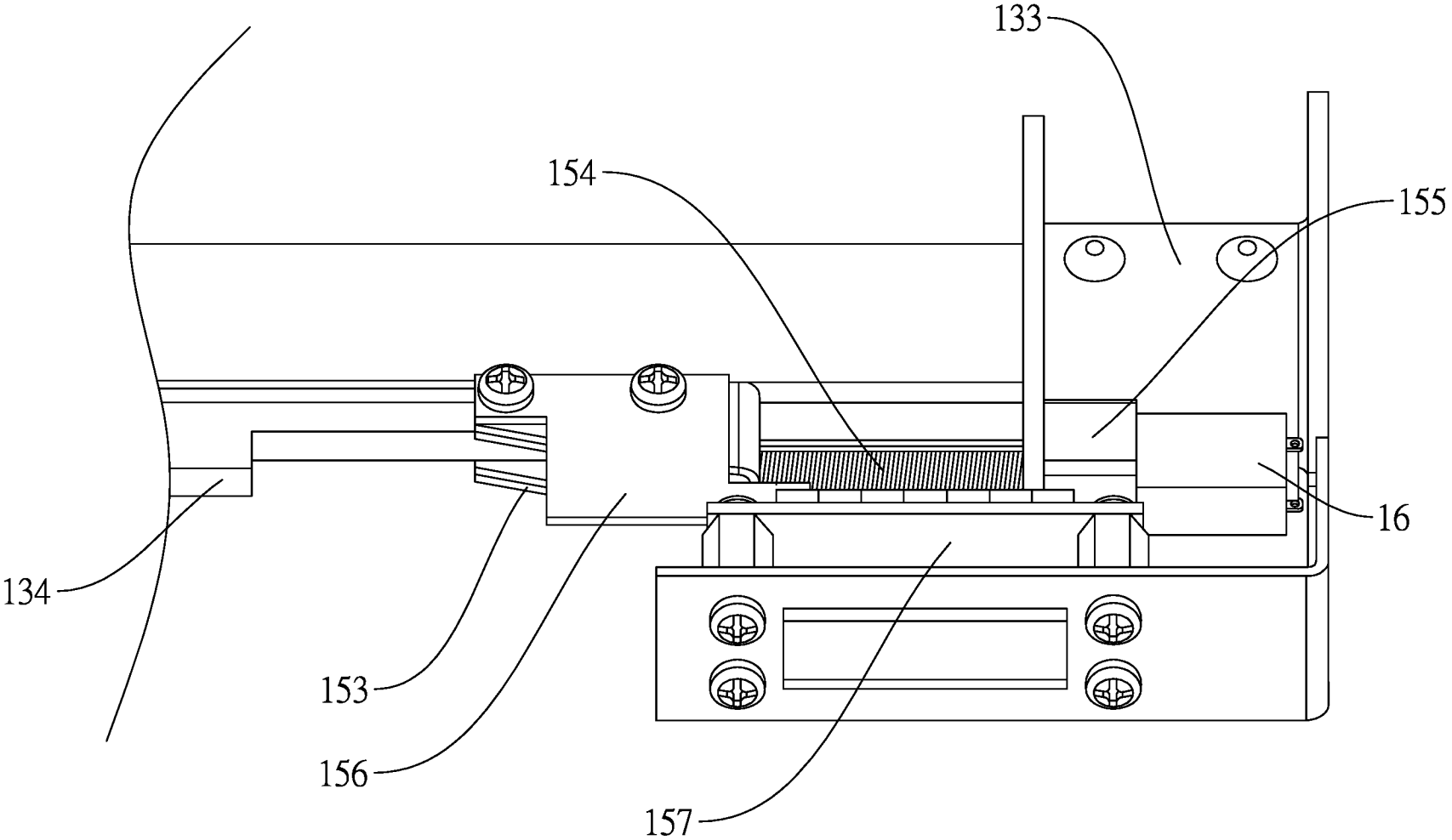
FIG. 13 schematically depicts the driven device and the drive device.

Referring to FIGS. 1 to 8, a hanging rod control device 1 for a display rack in accordance with a first preferred embodiment of the invention comprises a mounting member 11, a rod 12, a positioning assembly 13, a release assembly 14, a driven device 5 and a drive device 16 as discussed in detail below.

The mounting member 11 is adapted to attach to a display rack (not shown). The rod 12 has one end secured to the mounting member 11 so that a plurality of items (not shown) may be hung from the rod 12. The positioning assembly 13 is secured to the mounting member 11 and includes a front plate 131, a rear fastening member 133, a shaft 132 interconnecting the front plate 131 and the rear fastening member 133, and a sliding member 134. The shaft 132 and the rod 12 are parallel to each other. The shaft 132 includes a grooved rail 1321 for allowing the sliding member 134 to slide between two ends of the grooved rail 1321. The sliding member 134 includes a plurality of teeth 1341 in which the more proximate the mounting member 11 the greater of the length of the tooth 1341 is. A projecting light emitting member 1311 is provided on an outer surface of the front plate 131. A label 1312 is provided on the outer surface of the front plate 131 and has a numeral 01 printed thereon. An audio signaling member 1313 is provided on an inner surface of the front plate 131. The sliding member 134 further comprises an elastic member 1342 through the rear fastening member 133. After the sliding member 134 has slid, the elastic member 1342 may apply an elastic force to cause the sliding member 134 to return to inoperative position.

The release assembly 14 is penetrated by both the shaft 132 and the sliding member 134 and disposed between the mounting member 11 and the front plate 131. The release assembly 14 includes a plurality of arms 141 and a plurality of positioning plates 142 arranged horizontally in alternating fashion. The release assembly 14 further comprises a rear spacer 143 of a predetermined length between the positioning plates 142 and the mounting member 11. Thus, the release assembly 14 comprises, from a front end to a rear end, the arms 141, the positioning plates 142 and the rear spacer 143. The arm 141, the positioning plate 142 and the rear spacer 143 each includes a through hole 1411, 1421, or 1431 so that both the shaft 132 and the sliding member 134 may pass through the through holes 1411, 1421 and 1431.

The arm 141 further comprises a plurality of positioning apertures 1412, a recess 1413 on an edge of the through hole 1411 for allowing the arm 141 to pivot a predetermined angle, and a cavity 1414 for allowing the rod 12 to complementarily attach thereto.

The positioning plate 142 further comprises a pin 1422 adapted to insert into the positioning aperture 1412 for positioning the arm 141, and a plurality of hole members 1423 each for the receipt of the pin 122. The pin 1422 has a half-spherical end for making the insertion of the pin 1422 into the positioning aperture 1412 easy.

The driven device 15 is provided in the mounting member 11 and includes a cam 151 having a plurality of connected facets on an inner surface, and a shaft member 152 operatively connected to the cam 151. The drive device 16 is provided in the mounting member 11 and operatively connected to the shaft member 152. The drive device 16 is the drive source of the invention.

Referring to FIGS. 8 to 13, a hanging rod control device 1 for a display rack in accordance with a second preferred embodiment of the invention is shown. The characteristics of the second preferred embodiment are discussed below.

The hanging rod control device 1 comprises a mounting member 11, a rod 12, a positioning assembly 13, a release assembly 14, a driven device 5 and a drive device 16 as discussed in detail below.

The mounting member 11 is adapted to attach to a display rack (not shown). The rod 12 has one end secured to the mounting member 11 so that a plurality of items (not shown) may be hung from the rod 12. The positioning assembly 13 is secured to the mounting member 11 and includes a front plate 131, a rear fastening member 133, a shaft 132 interconnecting the front plate 131 and the rear fastening member 133, and a sliding member 134. The shaft 132 and the rod 12 are parallel to each other. The shaft 132 includes a grooved rail 1321 for allowing the sliding member 134 to slide between two ends of the grooved rail 1321. The sliding member 134 includes a plurality of teeth 1341 in which the more proximate the mounting member 11 the greater of the length of the tooth 1341 is. A projecting light emitting member 1311 is provided on an outer surface of the front plate 131. A label 1312 is provided on the outer surface of the front plate 131 and has a numeral 01 printed thereon. An audio signaling member 1313 is provided on an inner surface of the front plate 131.

The release assembly 14 is penetrated by both the shaft 132 and the sliding member 134 and disposed between the mounting member 11 and the front plate 131. The release assembly 14 includes a plurality of arms 141 and a plurality of positioning plates 142 arranged horizontally in alternating fashion. The release assembly 14 further comprises a rear spacer 143 of a predetermined length between the positioning plates 142 and the mounting member 11. Thus, the release assembly 14 comprises, from a front end to a rear end, the arms 141, the positioning plates 142 and the rear spacer 143. The arm 141, the positioning plate 142 and the rear spacer 143 each includes a through hole 1411, 1421, or 1431 so that both the shaft 132 and the sliding member 134 may pass through the through holes 1411, 1421 and 1431.

The arm 141 further comprises a plurality of positioning apertures 1412, a recess 1413 on an edge of the through hole 1411 for allowing the arm 141 to pivot a predetermined angle, and a cavity 1414 for allowing the rod 12 to complementarily attach thereto.

The positioning plate 142 further comprises a pin 1422 adapted to insert into the positioning aperture 1412 for positioning the arm 141. The pin 1422 has a half-spherical end for making the insertion of the pin 1422 into the positioning aperture 1412 easy.

The driven device 15 is provided in the mounting member 11 and includes a connector 153 connected to the sliding member 134, a lead screw 154 connected to the connector 153 for allowing the sliding member 134 to move thereon, a fastening element 155 for securing the lead screw 154 to the rear fastening member 133, a sensor plate 156 secured to the connector 153, and a sensor member 157 for calculating a moving distance of the sliding member 134 based on data transmitted from the sensor plate 156. The drive device 16 is operatively connected to the fastening element 155. The drive device 16 is the drive source for rotating the lead screw 154.

Figure 14B:
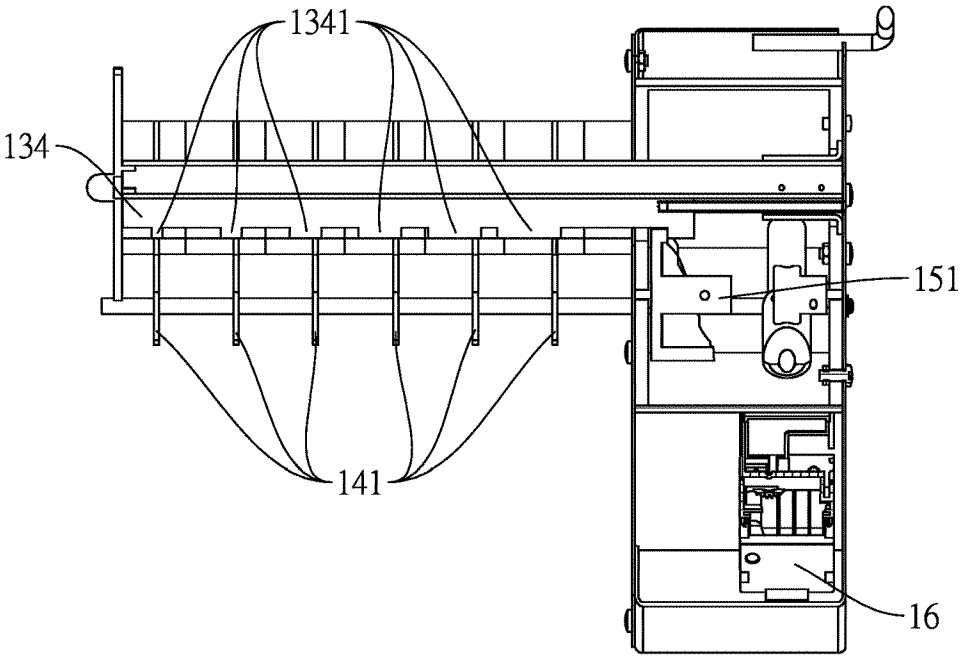
FIG. 14B is a sectional view taken along line A-A of FIG. 14A.
Figure 14A:
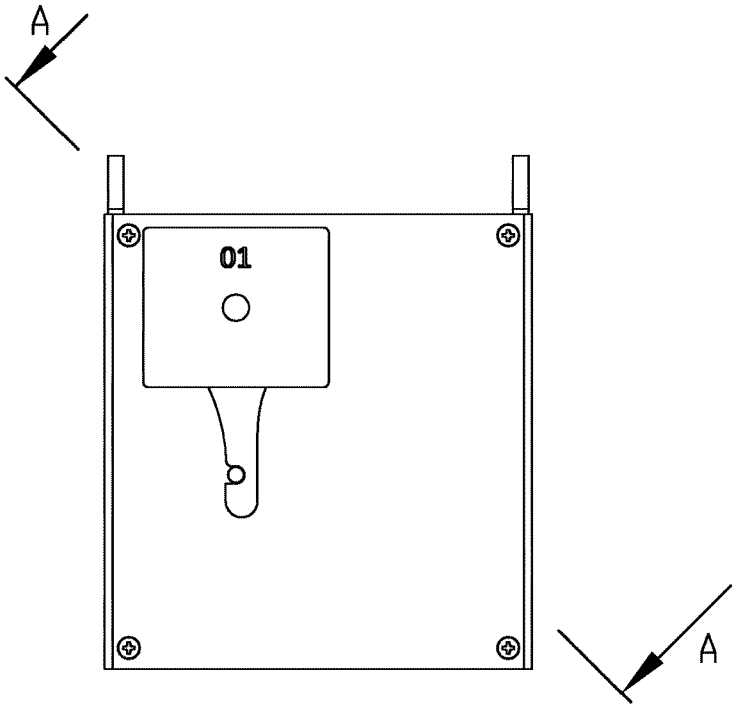
FIG. 14A is a front view of FIG. 9.
Figure 15:
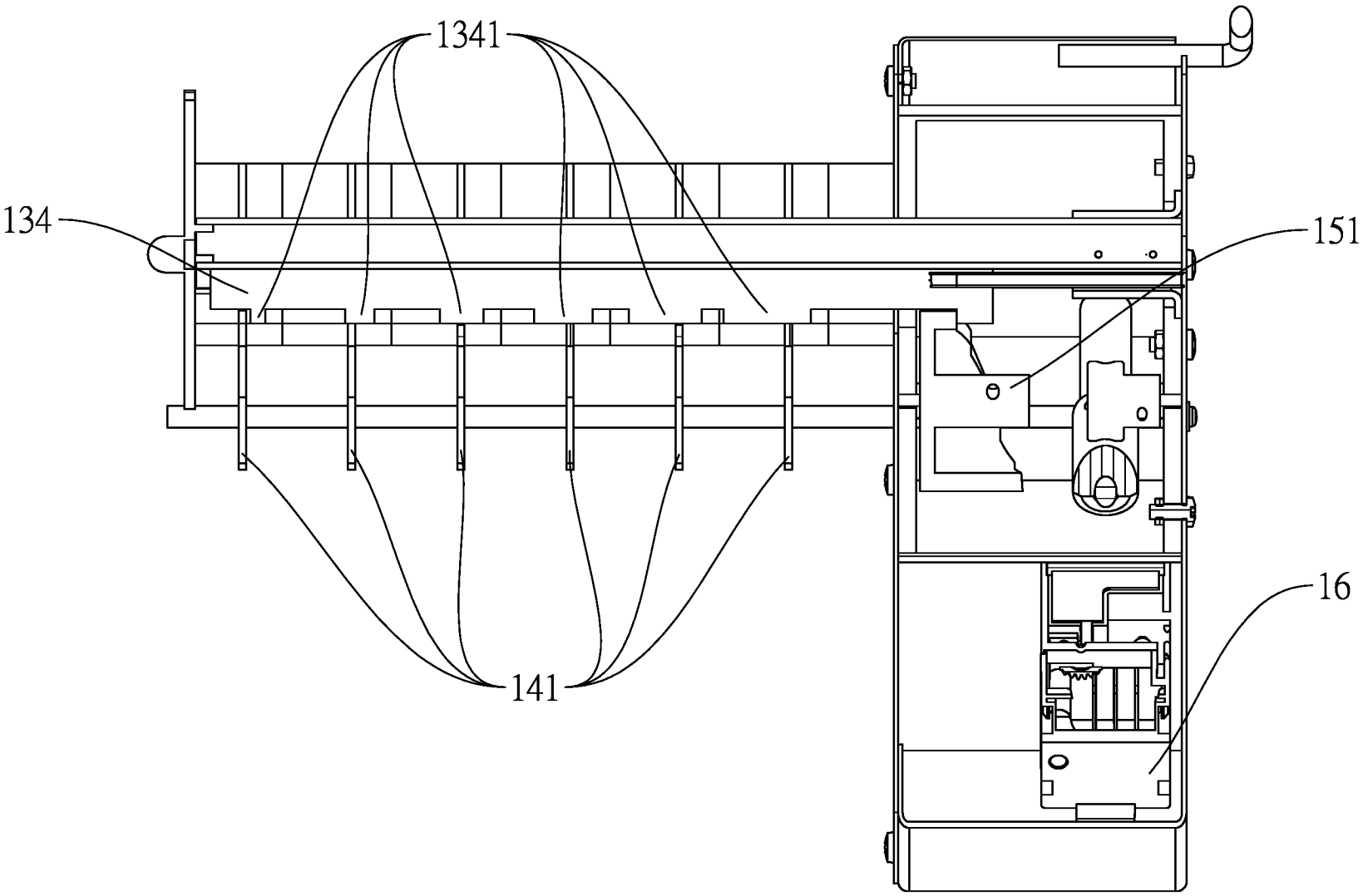
FIG. 15 is a view similar to FIG. 14B showing a first operation of the hanging rod control device for a display rack according to the first preferred embodiment.

Referring to FIGS. 14A to 17, operation of the invention is described in detail below. As shown in FIGS. 14A, 14B and 15 specifically and in conjunction with FIGS. 5 and 6, operation of the hanging rod control device 1 for a display rack in accordance with a first preferred embodiment is discussed in detail below.

There are six arms 141 and the number of the arms 141 can be adjusted based applications. The drive device 16 produces a rotary force for rotating the cam 151. In an initial (i.e., inoperative) position of the cam 151, the teeth 1341 of the sliding member 134 are in the through holes 1411 of the arms 141 respectively. Thus, the arms 141 are locked. After the cam 151 has rotated a first angle, the sliding member 134 may move rearward a first distance to cause the foremost tooth 1341 to clear the through hole 1411 of the foremost arm 141. Thus, the foremost arm 141 is unlocked (i.e., being free to move). The pin 1422 may insert into the positioning aperture 1412 to lock the arm 141 after the arm 141 has pivoted to a specific angle. As an end, the item hung on the arm 141 is released. As described above, the more proximate the mounting member 11 the greater of the length of the tooth 1341 is. First, the foremost tooth 1341 may clear the through hole 1411 of the foremost arm 141 first when the cam 151 pivots and the remaining teeth 1341 are still locked in the through holes 1411 of the other arms 141.

Figure 16:
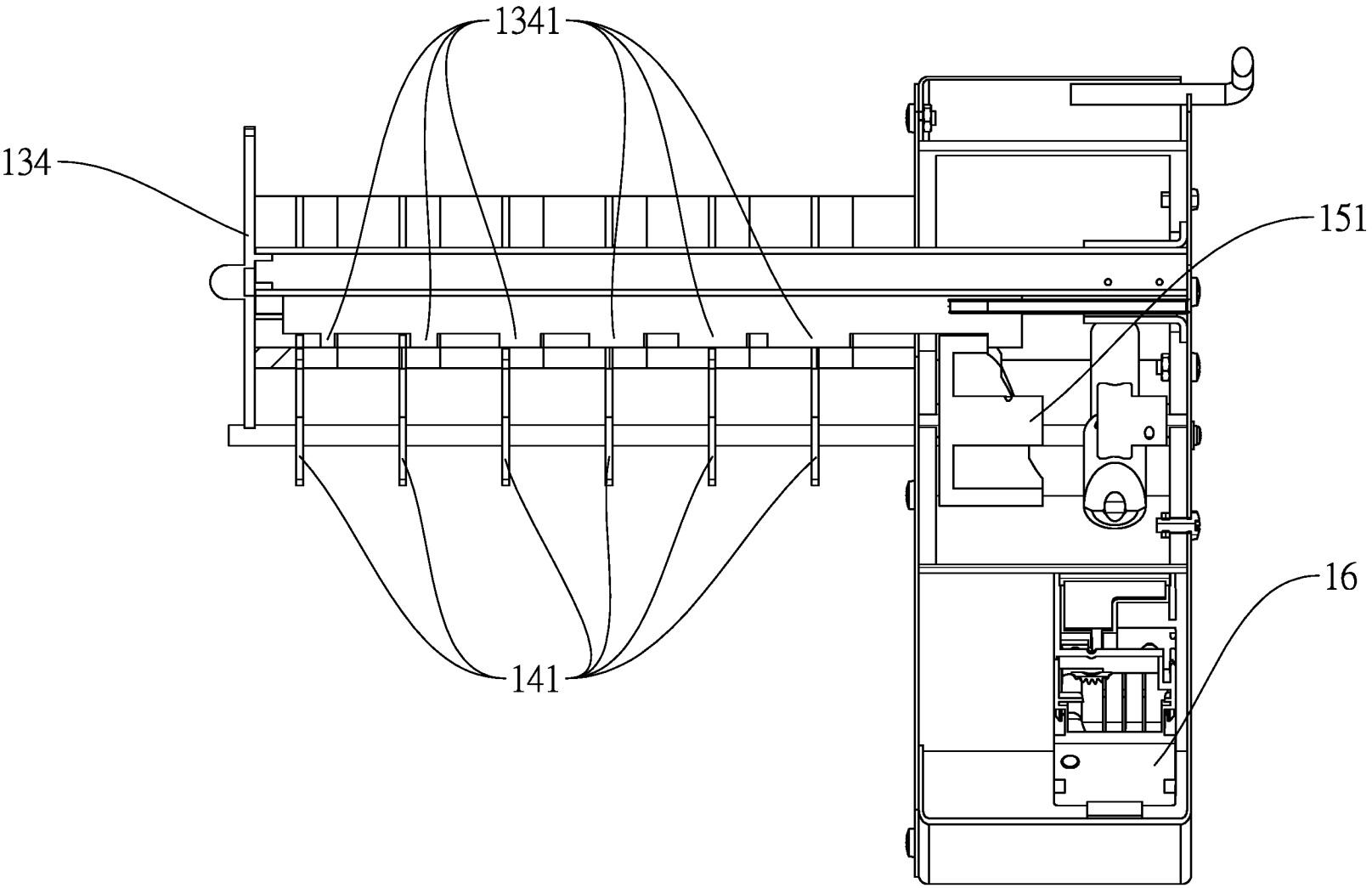
FIG. 16 is a view similar to FIG. 14B showing a second operation of the hanging rod control device for a display rack according to the first preferred embodiment.

Referring to FIG. 16 specifically, operation of the hanging rod control device 1 for a display rack in accordance with the first preferred embodiment of the invention is further detailed below. After the cam 151 has rotated a second angle in addition to the first angle, the sliding member 134 may move rearward a second distance in addition to the first distance to cause the tooth 1341 adjacent to the foremost tooth 1341 (i.e., the second tooth 1341 counted from the foremost tooth 1341) to clear the through hole 1411 of the arm 141 adjacent to the foremost arm 141 (i.e., the second arm 141 counted from the foremost arm 141). Thus, the second arm 141 is unlocked (i.e., being free to move).

Likewise, after the cam 151 has rotated a third angle in addition to the second angle, the sliding member 134 may move rearward a third distance in addition to the second distance to cause the third tooth 1341 to clear the through hole 1411 of the third arm 141. Thus, the third arm 141 is unlocked.

Still likewise, after the cam 151 has rotated a fourth angle in addition to the third angle, the sliding member 134 may move rearward a fourth distance in addition to the third distance to cause the fourth tooth 1341 to clear the through hole 1411 of the fourth arm 141. Thus, the fourth arm 141 is unlocked.

Still likewise, after the cam 151 has rotated a fifth angle in addition to the fourth angle, the sliding member 134 may move rearward a fifth distance in addition to the fourth distance to cause the fifth tooth 1341 to clear the through hole 1411 of the fifth arm 141. Thus, the fifth arm 141 is unlocked.

Figure 17:
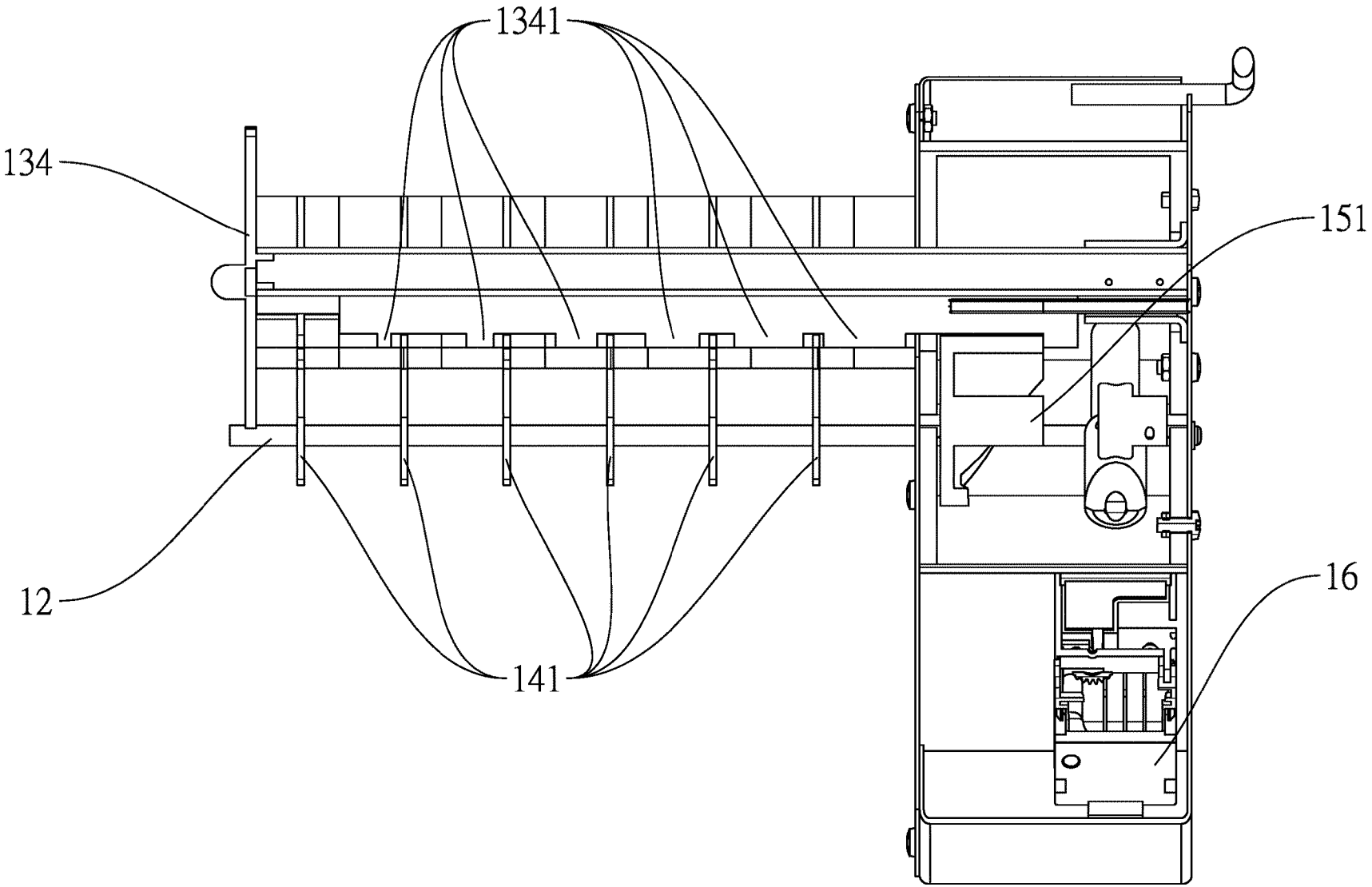
FIG. 17 is a view similar to FIG. 14B showing a third operation of the hanging rod control device for a display rack according to the first preferred embodiment.

Referring to FIG. 17 specifically, operation of the invention is further detailed below. After the cam 151 has rotated a sixth angle in addition to the fifth angle, the sliding member 134 may move rearward a sixth distance in addition to the fifth distance to cause the sixth tooth 1341 to clear the through hole 1411 of the sixth arm 141. Thus, the all arms 141 are unlocked (i.e., being free to move).

There are two methods for replenishment after all arms 141 have been unlocked. A first method is detailed below. The cam 151 may return to its inoperative position after having rotated a seventh angle in addition to the sixth angle. But, the arms 141 do not return to their inoperative positions. Thus, the teeth 1341 are not capable of entering the through holes 1411 of the arms 141. It is required to replenish the items by hooking them onto the rod 12. Also, only one item is hung on the rod 12 between two adjacent arms 141. Next, the arms 141 are returned to their inoperative positions. Also, the through holes 1411 are aligned with the teeth 1341 and the elastic member 1342 pushes the sliding member 134 forward. And in turn, the teeth 1341 begin to enter the through holes 1411 of the arms 141. Further, the sliding member 134 returns to its inoperative position. After the teeth 1341 have entered the through holes 1411 of the arms 141, all arms 141 are locked.

A second method of returning the sliding member 134 is detailed below. First, all items to be replenished are hung on the rod 12. Also, only one item is hung on the rod 12 between two adjacent arms 141. Next, all arms 141 are returned to their inoperative positions. Further, the cam 151 is rotated a seventh angle in addition to the sixth angle while an end of the sliding member 134 returns from the highest stage to the lowest stage along the track of the cam 151. Furthermore, the elastic member 1342 pushes the sliding member 134 forward. After the sliding member 134 has slid to its inoperative position, all teeth 1341 enter the through holes 1411 of the arms 141, all arms 141 are locked.

Operation of the hanging rod control device 1 for a display rack in accordance with the second preferred embodiment of the invention is substantially the same as that of the hanging rod control device 1 for a display rack in accordance with the first preferred embodiment of the invention except the following: a clockwise rotation of the lead screw 154 pushes the sliding member 134 rearward while the sensor member 157 determines position of the sensor plate 156. As such, the moving distance of the sliding member 134 can be controlled. After all arms 141 have been unlocked, replenishment is done. In detail, all items are hung on the rod 12 and only one item is hung on the rod 12 between two adjacent arms 141. Next, all arms 141 are returned to their inoperative positions. Further, a counter-clockwise rotation of the lead screw 154 pushes the sliding member 134 to its inoperative position.

Figure 18:
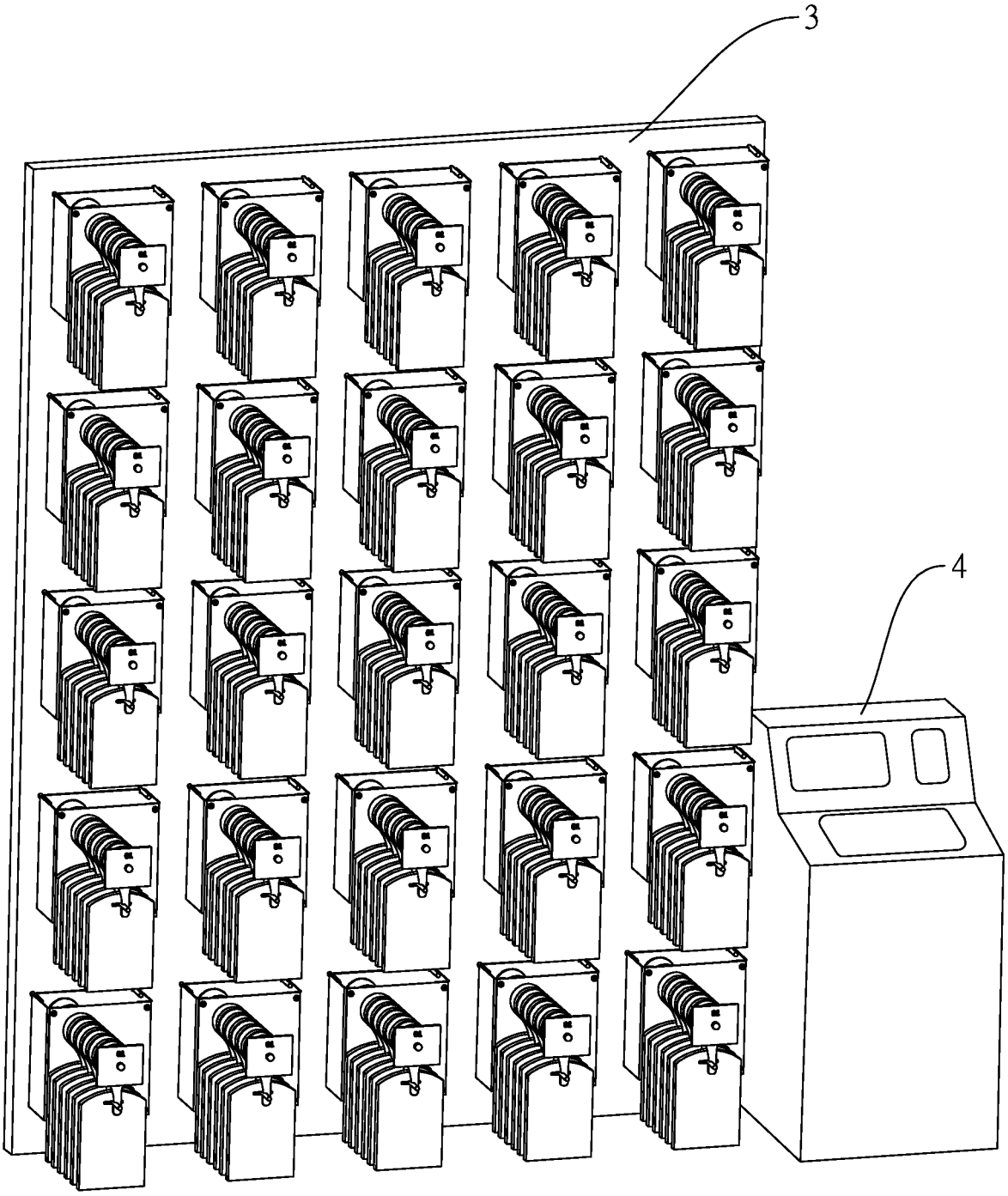
FIG. 18 is a perspective view of a display rack and a console for controlling the display rack.
Figure 19:
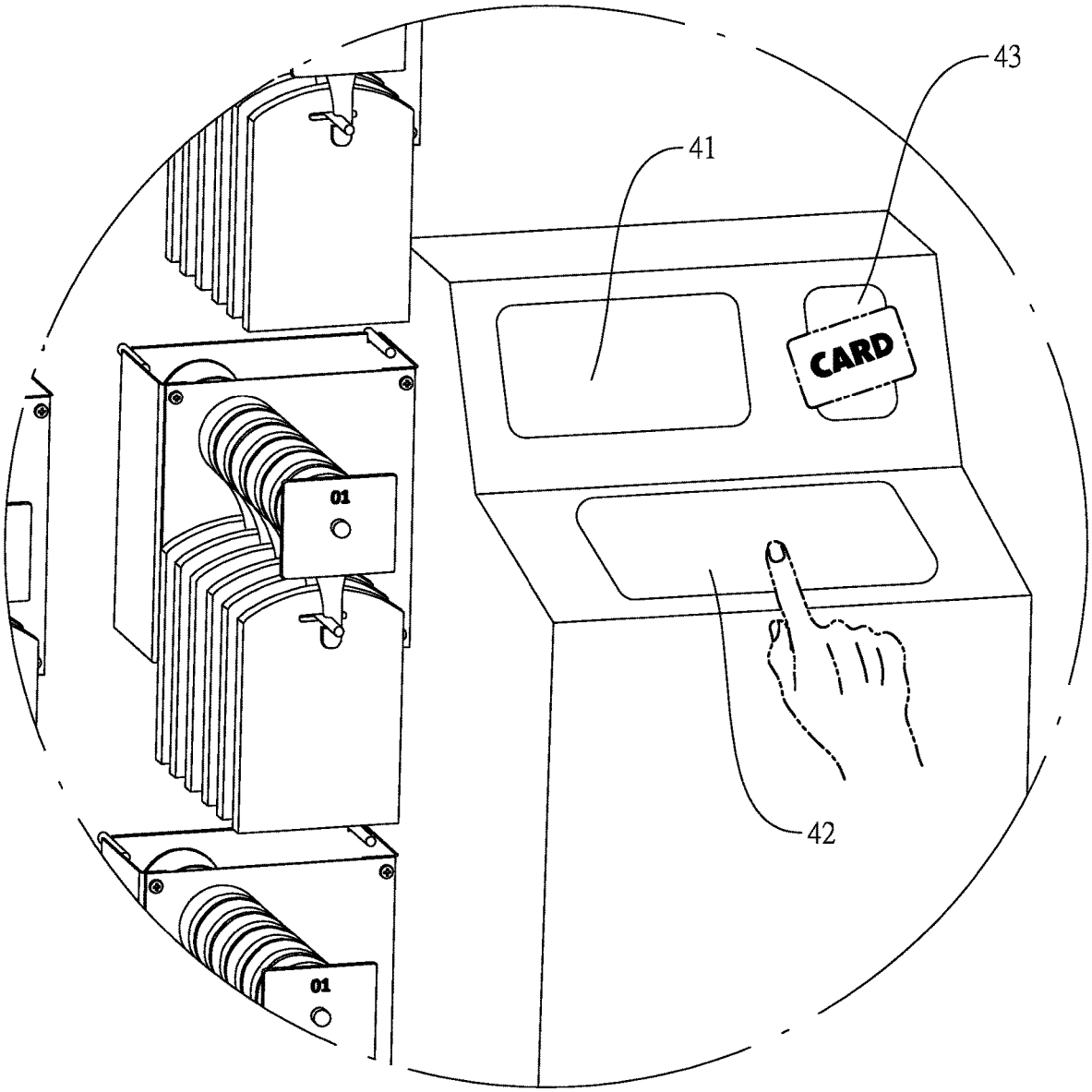
FIG. 19 is a detailed view of a portion of FIG. 18.
Figure 20:
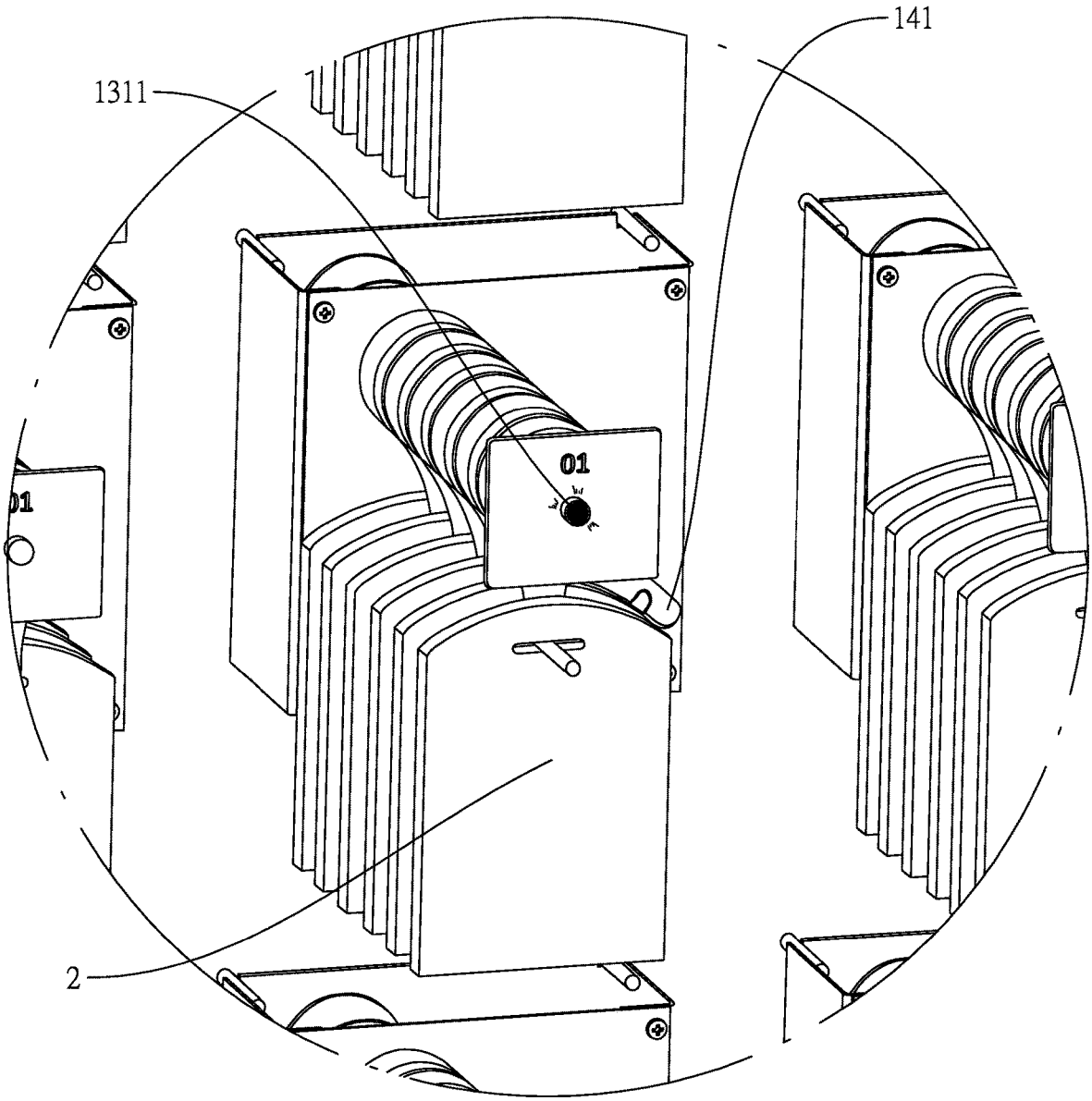
FIG. 20 is a detailed view of the display rack of FIG. 18.

Referring to FIGS. 18, 19 and 20 in conjunction with FIGS. 1 to 17, the hanging rod control device 1 for a display rack in accordance with the first or second preferred embodiment of the invention is mounted on a display rack 3 and a console 4 is provided adjacent thereto. An operation mode of a vending machine is thus made possible. A plurality of items (e.g., hand tools) 2 are hung for display.

In an application of the invention, a plurality of hand tools 2 are hung on the display rack 3 which is located at a factory. Thus, an employee may easily access the hand tools in case of a need arises. In detail, an employee may touch a touchscreen 41 of the console 4 or press one or more buttons on a keypad 42 of the console 4 to select a desired kind of the hand tool 2 and its number. Further, the employee may place his or her identification on a sensor zone 43 of the console 4. After the identification has been verified, the hanging rod control device 1 may activate the light emitting member 1311 to flash or light, and activate the audio signaling member 1313 to generate sound (see FIGS. 4 and 12). The employee may open the desired arms 141 to allow the hand tools 2 to drop based on instructions of the flashing (or light) and the sound. After taking the hand tools 2, the console 4 may transmit the transaction data to a management authority which is thus aware of the released hand tools 2. Furthermore, the management authority may arrange replenishment to be done and date for the replenishment.

The hanging rod control device for a display rack in accordance with the invention has the following characteristics and advantages:

The driven device is used to control a moving distance of the sliding member. Further, whether a pivotal operation of the arm is made is based on the moving distance of the sliding member. As such, a precise control of the items sold by the vending machine is made possible. Furthermore, an operation mode of the vending machine is improved to an open mode. In addition, a console is used to control each hanging rod control device for a display rack, thereby greatly decreasing the labor costs.

While the invention has been described in terms of preferred embodiments, those skilled in the art will recognize that the invention can be practiced with modifications within the spirit and scope of the appended claims.

What is claimed is:

1. A hanging rod control device for a display rack, comprising a mounting member, a rod, a positioning assembly, a release assembly, a driven device, and a drive device wherein:

the mounting member is configured to attach to the display rack;

the rod has one end secured to the mounting member so that a plurality of items are configured to hang from the rod;

the positioning assembly is secured to the mounting member and includes a front plate, a rear fastening member, a shaft interconnecting the front plate and the rear fastening member, and a sliding member wherein the shaft and the rod are parallel to each other; the shaft includes a grooved rail for allowing the sliding member to slide between two ends of the grooved rail; the sliding member includes a plurality of teeth; the more proximate the mounting member the greater of a length of the teeth is; and the front plate includes a light emitting member on an outer surface; and a label on the outer surface of the front plate;

the release assembly is penetrated by both the shaft and the sliding member and disposed between the mounting member and the front plate; the release assembly includes a plurality of arms and a plurality of positioning plates arranged in alternating fashion; the arms and the positioning plates each include a through hole so that both the shaft and the sliding member are configured to pass through the through holes; each arm further comprises a plurality of positioning apertures, a recess on an edge of the through hole of the arm for allowing the arm to pivot a predetermined angle, and a cavity for allowing the rod to complementarily attach thereto; and each positioning plate further comprises a pin configured to insert into the positioning aperture for positioning the arm, and a plurality of hole members each for the receipt of the pin;

the driven device is disposed in the mounting member and includes a connector connected to the sliding member, a lead screw connected to the connector for allowing the sliding member to move thereon, and a fastening element for securing the lead screw to the rear fastening member; and the drive device is disposed in the mounting member and operatively connected to the fastening element; and the drive device is configured to be a drive source for rotating the lead screw.

2. The hanging rod control device for a display rack of claim 1, further comprising an audio signaling member disposed on an inner surface of the front plate.

3. The hanging rod control device for a display rack of claim 1, wherein the release assembly further comprises a rear spacer between the positioning plates and the mounting member, the rear spacer including a through hole.

4. The hanging rod control device for a display rack of claim 1, wherein the driven device further comprises a sensor plate secured to the connector, and a sensor member for calculating a moving distance of the sliding member based on data transmitted from the sensor plate.

* * * * *